US005242351A

United States Patent [19]

Berg et al.

[11] Patent Number: 5,242,351

[45] Date of Patent: Sep. 7, 1993

[54] FLYWHEEL INERTIAL EXERCISE DEVICE

[76] Inventors: Ernst H. E. Berg; Mats-Ake Berg, both of Banérgatan 73, S-115 26 Stockholm, Sweden

[21] Appl. No.: 761,911

[22] PCT Filed: Mar. 14, 1990

[86] PCT No.: PCT/SE90/00162

§ 371 Date: Sep. 12, 1991

§ 102(e) Date: Sep. 12, 1991

[87] PCT Pub. No.: WO90/10475

PCT Pub. Date: Sep. 20, 1990

[30] Foreign Application Priority Data

Mar. 16, 1989 [SE] Sweden ..... 8900946

[51] Int. Cl.[5] ..... A63B 21/22

[52] U.S. Cl. ..... 482/110; 482/63

[58] Field of Search ..... 482/110, 116, 127, 72, 482/57, 65, 63

[56] References Cited

U.S. PATENT DOCUMENTS

| | | | |
|---|---|---|---|
| 1,783,376 | 12/1930 | Duff | 482/110 |
| 2,603,486 | 7/1952 | Hughes . | |
| 2,951,702 | 7/1960 | Goodwin | 482/110 |
| 3,432,164 | 3/1969 | Deeks | 482/63 |
| 3,841,627 | 10/1974 | Vetter . | |
| 3,929,331 | 12/1975 | Beeding | 482/116 |
| 3,995,853 | 12/1976 | Deluty | 482/116 |
| 4,077,626 | 3/1978 | Newman | 482/116 |
| 4,625,962 | 12/1986 | Street | 482/72 |
| 4,632,392 | 12/1986 | Peyton et al. . | |

FOREIGN PATENT DOCUMENTS

| | | |
|---|---|---|
| 2646956 | 4/1978 | Fed. Rep. of Germany . |
| 3049227 | 7/1982 | Fed. Rep. of Germany . |
| 400474 | 4/1978 | Sweden . |

*Primary Examiner*—Richard J. Apley
*Assistant Examiner*—Lynne A. Reichard
*Attorney, Agent, or Firm*—Nies, Kurz Bergert & Tamburro

[57] ABSTRACT

A method for training or exercising muscles with the aid of training or exercising equipment and, when appropriate, for determining training conditions.

The method is mainly characterized by loading relevant muscles of the training person by increasing or decreasing the rotational energy (E(kin)), kinetic energy, or a rotatably mounted flywheel (1).

The invention also relates to equipment for carrying out the method.

31 Claims, 3 Drawing Sheets

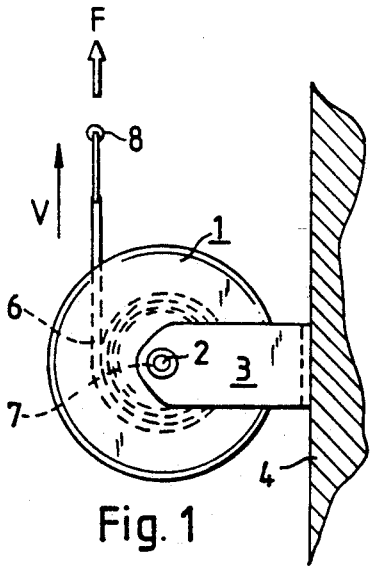
Fig. 1
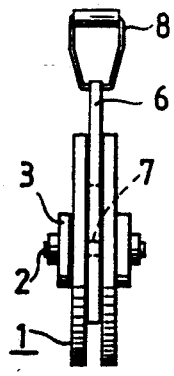
Fig. 2
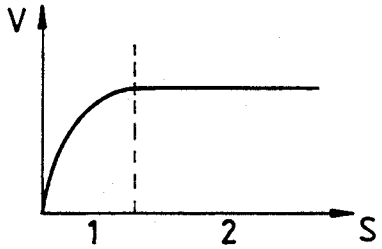
Fig. 3
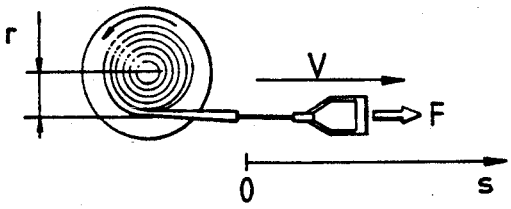
Fig. 4
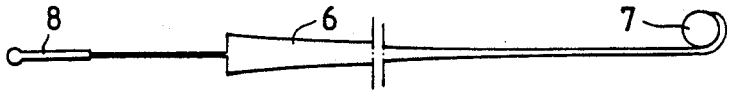
Fig. 5
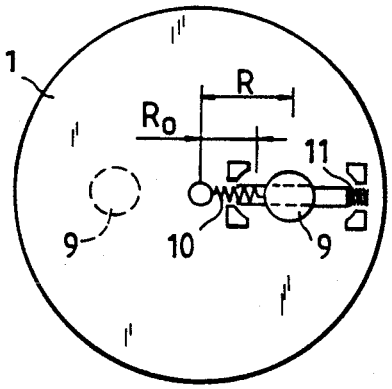
Fig. 6
Fig. 7
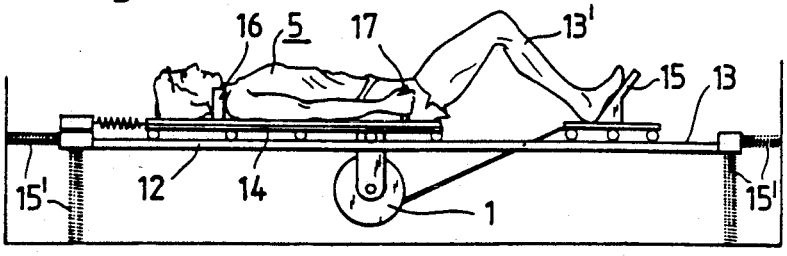

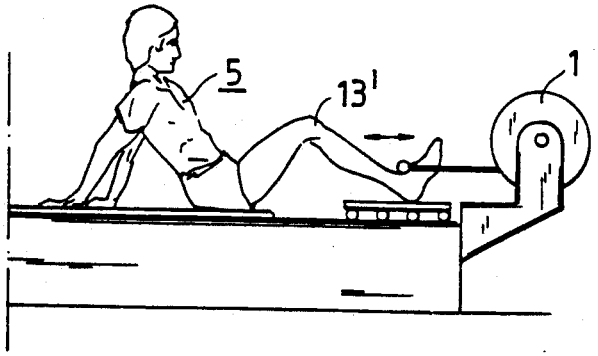
Fig. 8
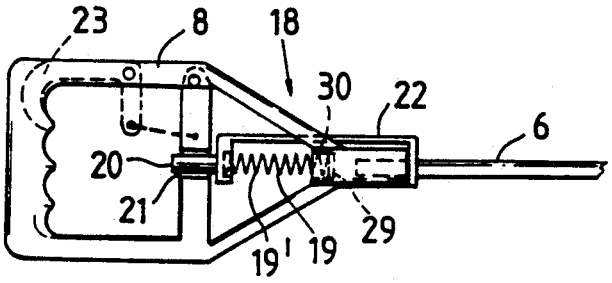
Fig. 9
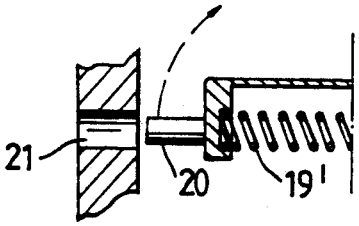
Fig. 10
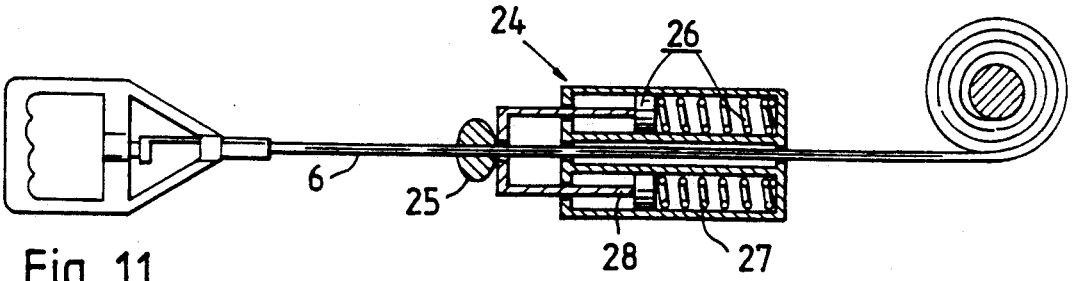
Fig. 11
Fig. 12
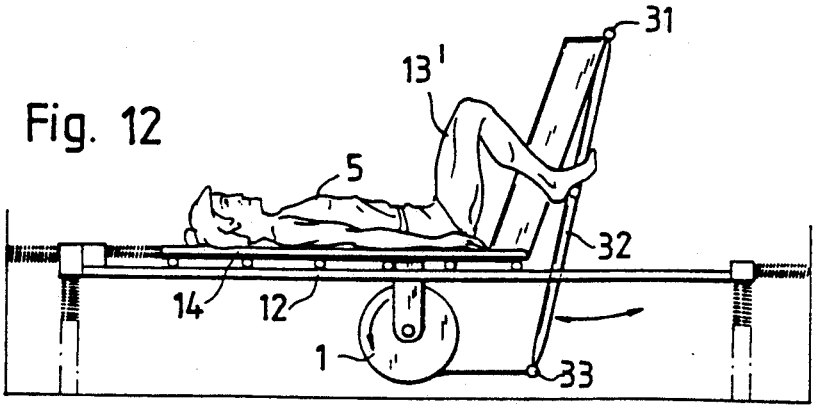

Fig. 13
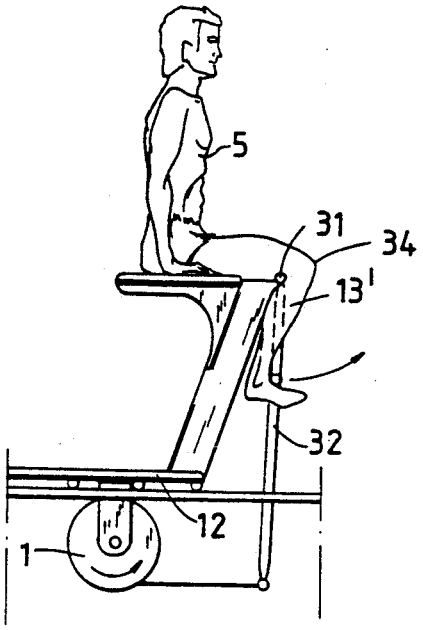
Fig. 14
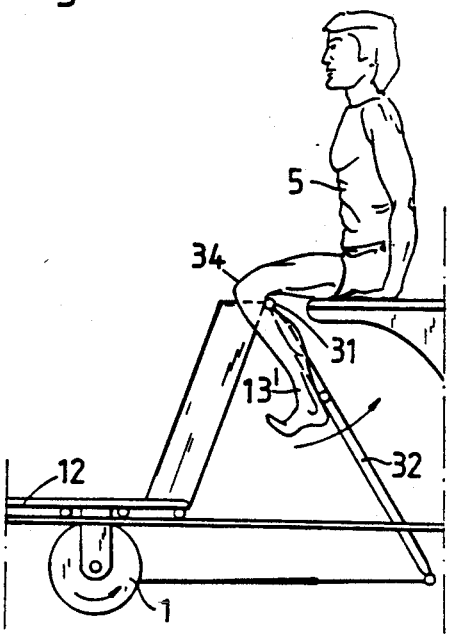
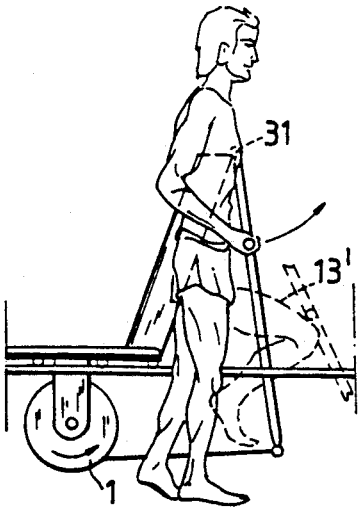
Fig. 15
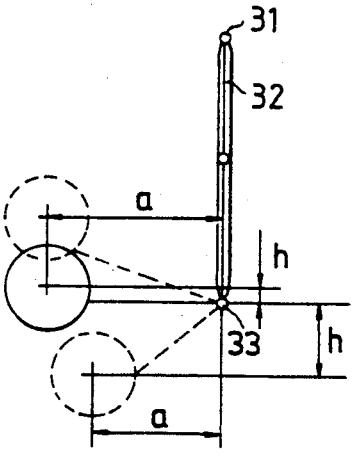
Fig. 16

FLYWHEEL INERTIAL EXERCISE DEVICE

The present invention relates to a method for carrying out muscle exercises and, when appropriate, for measuring exercising conditions.

The invention also relates to equipment for carrying out the method.

The work performed by muscles can be divided into two categories. Concentric work, also referred to as positive work, in which the muscle is shortening (contracting) under an applied load, and eccentric work, also referred to as negative work, during which the muscle is lengthening during muscle work. For instance, concentric work is performed predominantly when lifting a barbell, whereas eccentric work is performed predominantly when lowering the weight. The force or power developed by skeletal muscle for a given rae of shortening or lengthening, often expressed as point angular velocity, is always generate in the case of eccentric work than in the case of concentric work. The force is often expressed as the torque prevailing in the joint concerned.

The well-known movement of lifting a dumbbell with the vertically hanging arm, by bending the elbow (so-called biceps curl) will be used hereinafter to illustrate the conditions that prevail during muscle training exercises.

Similar to he majority of the joints of the body, maximum strength, or torque, is achieved in the elbow joint during the mid phase, when the arm is bent at right angles. When performing the above-mentioned dumbbell training, a relatively favorable loading is obtained during said movement, since the gravitational force exerted by the dumbbell will exert maximum resistance to the concentric training or exercise movement in the position in which the force or power in the elbow joint reaches its maximum.. the minor lever arm of the gravitational force will result in a relatively light load, both at the beginning and at the end of the movement. The mid phase of he movement, however, is the most difficult to pass, and hence the speed of the movement will fall and the muscle will not be loaded to a maximum throughout the whole movement.

In strength-training exercises, it is necessary to achieve constant, maximum voluntary muscle tension and a constant shortening and lengthening rate during the whole movement, in order to achieve maximum effect in training. It is not suitable to use conventional springs in such muscle-training exercises, since said movement is retarded progressively by the increasing load.

When exercising or training muscles with the aid of conventional equipment, such as barbells and dumbbells, difficulties re experienced in maintaining maximum muscl tension throughout the whole movement concerned, and in maintaining is kinecy=constant change rate in muscle length, since linear inertia forces, primarily at high movement speeds, e.g. ballistic movements; throwing movements, are highly influential. complicated transmission devices can be used in this respect, although such devices are specific for each movement to be carried out and are abnormally both expensive and bulky and are furthermore limited by he anatomical differences between individuals concerned. Furthermore, heavy weights are required when large groups of muscles are to be exercised or trained. Many kinds of training machines provided with weight stacks are to be found as a replacement for training with free weights. These machines, however, are respected by significant energy losses in the form of friction. Consequently, the eccentric training phase is far less demanding than the concentric training phase, Since the eccentric muscle strength is greater, it will be evident that much of the training effect is lost in this training phase.

Several different types of training equipment employ friction to obtain a desired load profile, although normally it is only possible to carry out concentric training.

The present invention relates to a novel training method and training equipment capable of creating a well-defined speed profile during both concentrical and eccentrical muscle work in the absence of significant energy losses. The equipment is light in weight and requires only small space in comparison with conventional strength-training equipment, which enables the equipment to be used in the home and in the hospital bed for training or exercising a number of muscle-groups in the body The invention thus relates to a method for exercising or training muscles with the aid of training equipment and, when appropriate, for measuring and determining training conditions. The method is particularly characterized in that the training person loads the relevant muscles, by increasing or decreasing the rotational energy (E(kin)), kinetic energy, of a rotatable flywheel.

the invention also relates to training equipment for training or exercising muscles and, when appropriate, for measuring training conditions. The equipment is mainly characterized by a rotatable flywheel which functions to load the relevant muscles o the training person, by increasing or decreasing the rotational energy (E(kin)), kinetic energy, of the flywheel, and the equipment further includes flywheel-activating means operable by the training person.

The invention will now be described in more detail with reference to exemplifying embodiments thereof illustrated in the accompanying drawings, in which FIG. 1 illustrates schematically a first embodiment of inventive equipment, seen at right angles to the plane of the flywheel;

FIG. 2 illustrates the equipment of FIG. 1 from the left in said figure;

FIG. 3 is a graph which illustrates pull-off speed as an often preferred function of the extended length;

FIG. 4 is a sketch of the inventive equipment intended for explaining the measuring of reference signs;

FIG. 5 illustrates schematically a pull-device, a pull belt or strap, seen transversely to its longitudinal direction and its thickness direction;

FIG. 6 is a schematic side view of a flywheel operative to vary inertia forces by varying weight distribution;

FIG. 7 is a schematic side view of a leg training device for use in a horizontal position, particularly in a weightless environment;

FIG. 8 is a schematic side view of part of another horizontal leg-training device;

FIG. 9 illustrates schematically a safety release device provided in handle means and operative to break the connection between said handle means and said pull-device under given conditions;

FIG. 10 illustrates pat of a safety release device according to FIG. 9, with the device in its released state;

FIG. 11 is a longitudinal section through a safety brake arrangement operative to retard or brake the flywheel through the medium of a pull-belt;

FIG. 12 is a schematic side view of an arrangement substantially in accordance with FIG. 7, although with the flywheel activated indirectly via a lever arm;

FIG. 13 illustrates schematically part of an arrangement substantially according to FIG. 12, arranged for knee-extension with the training person in a sitting position;

FIG. 14 illustrates schematically the arrangement of FIG. 13 intended for leg-curl training with the training person in a sitting position;

FIG. 15 illustrates schematically the arrangement of FIG. 13 intended for arm-curl training with the training person in a sitting position; and FIG. 16 illustrates schematically the various positions of the flywheel in relation to the free, loaded end of the lever arm in the case of an arrangement substantially according of FIGS. 12–15.

The equipment illustrated in FIGS. 1 and 2 includes a rotatable flywheel 1, which is rotatable about an axle 2. The reference numeral 3 identifies a racket structure by means of which the flywheel 1 can be mounted n a wall 4 or like support structure. The rotational energy (E(-kin)), kinetic energy, of the flywheel, can be increased or decreased for loading the relevant muscles of a training person 5, FIGS. 7 and 8. In the case of the embodiment illustrated in FIGS. 1 and 2, said energy is influenced by a pull-device 6 in the form of a belt, strap or like device 6, said pull-device being bound around a hub part 7 of the flywheel 1 and provided with a handle part 8 which is intended to be gripped by the training person, who as part of the training procedure can pull the belt 6, when coiled-up on the hub, wherewith the belt is unwound from the hub and said energy increased or else pull the belt 6k, holed the belt, when the belt has been unwound and the wheel set in rotation, therewith to retard rotation of the wheel.

As before mentioned, it is often desired to train or exercise with both constant and maximum muscle tension and with well-controlled speed of muscle shortening or lengthening, Constant shortening or lengthening speed in the muscle is corresponded here by a given pull-off speed, which is contingent on the joint anatomy concerned and the position of the flywheel. The desired pull-off speed v, FIGS. 1 and 4, is often near constant, however, as described hereinafter.

A desired movement stern is illustrated in FIG. 3, and comprises essentially two mutually different phases.

Phase 1 constitutes an acceleration phase, during width the pull-off speed v obtains a desired constant level as quickly as possible.

Phase 2 constitutes an isokinetic phase, during which, when v is constant, the angle velocity of the joints concerned, and primarily the shortening (contraction rate of the group of muscles trained are held relatively constant. Provided, inter alia, that the pulling force is constant, the following approximative relationships apply in the muscle-loading situation illustrated schematically in FIG. 4:

$$E(kin) = \int F ds = F \cdot s = \frac{J \cdot w^2}{2} \quad (1)$$

where

F=Pulling force s=The path travelled under the influence of the pulling force F

J=Moment of inertia of the flywheel w=The angular velocity obtained subsequent to s The influence of, inter alia, friction and kinetic energy stored in joints and muscles has been ignored. The following relationship also applies:

$$v = w \cdot r \quad (2)$$

where r=the radius

Provided that v is constant, the following expression is obtained from (1) and (2):

$$r = \frac{k}{\sqrt{s}} \quad (3)$$

where $$k = \text{a constant} = \sqrt{\frac{v^2 \cdot J}{2F}} \quad (4)$$

In order for v to be made constant or substantially constant, the geometry, thickness, of the pull-belt 6, the pull-device, can be varied so as to fulfill or substantially fulfill the expression (3). This is achieved by mans of an elongated pull-device whose shape narrows or tapers from is free end, provided with said handle means 8, i.e. The thickness of the belt decreases from said end. During phase 2, w will increase in accordance with $$w = \sqrt{s} \cdot \sqrt{\frac{2F}{J}} \quad (5)$$

Calculations are more difficult to carry out with regard to phase 1. A altering pull-belt with great thickness nearest the handle means, provides a desired rapid increase in sped. A thick pull-belt of substantially constant thickness is also able to provide a considerable effect during phase 1.

In the case of the pull-belt embodiment illustrated in FIG. 5, the rate of reduction in thickness of the belt deceases in a direction away from the handle means. Thus, FIG. 5 illustrates a method of varying the decreases in lever arm as opposed of the flywheel for influencing the relationship between the force exerted and the rate of muscle shortening for muscle lengthening.

In the case of the FIG. 6 embodiment, the moment of inertia of the flywheel is varied by varying weight distribution during flywheel rotation, so as to influence the relationship between the force exerted and the rate of muscle shortening or muscle lengthening. In the case of the illustrated embodiment, the flywheel includes at least one weight 9 which can be moved radially and which is intended to be displaced for redistribution of the weight in response to the rotational forces, centripetal forces, that occur. The moment of inertia increases when the weight is moved outwardly. The weight is preferably displaced against the action of a spring force, force example against the action of a helical spring 10 located inwardly in relation to the weight and tensioned when the weight is displaced outwards. The reference numeral 11 identifies a powerfull limit spring positioned externally in relation to the weight. The extreme change in pull-belt thickness required for achieving a substantially constant pull-off speed v, cannot be suitably applied in practice during phase 1, in which acceleration shall take place. In this respect , it is appropriate to employ redistribution of the weight in order to change the moment of inertia J. In this respect, the characteristics of the pull spring 10 can be used to control the change of J in response, inter alia, to the angular speed w. The flywheel may have several weights, as indicated by the broken-line weight 9 in FIG. 6, the various weights 9 conceivably having mutually different springs 10, so as to achieve a high degree of flexibility with regard to changes of J. Movement of the weight concerned is stopped by means of the limit spring 11, whereupon the change in J originating from this weight ceases. It is also conceivable to fixate the weight s in the radial direction, both beneath and above given rotational speeds.

A combination of varying moments of inertia and pull-belt configurations is an example of the flexibility permitting the characteristics of the equipment to be changed.

Calculations of the total moment of inertia as a function, for instance, of s can be carried out by specifying spring characteristic and employing equilibrium between spring force and centripetal force.

The following expression is obtained with designations, inter alia, according t FIG. 6:

$$J_{tot}=J_1+J_2 \tag{6}$$

where $J_{tot}$=The moment of inertia of flywheel plus weight (s)

$J_1$=The moment of inertia of the flywheel $J_2$=The moment of inertia of weight(s)

$$J_2=mF^2 \tag{7}$$

where m=Mass of the weight

R=The instantaneous radial position of the weight

R can be calculated from equilibrium between spring force of springs having linear characteristics an centripetal force:

$$F_f=k\cdot\Delta 1=k\cdot(R-R_o) \tag{8}$$

where $F_f$=spring force k=spring constant

Δl=length difference $R_o$=weight starting position $$F_o=\frac{mv_v^2}{R} \tag{9}$$

where $F_o$=centripetal force $V_v$=circumferential weight speed $$R=\frac{R_o}{\frac{1-mw^2}{K}} \tag{10}$$

From the work (F·s) and E(kin) carried out, there is obtained:

$$F\cdot s=\frac{Jw^2}{2}=\frac{(J_1+J_2)w^2}{2}=\frac{J_1w^2}{2}+\frac{mR^2\cdot w^2}{2} \tag{11}$$

-continued $$S=\frac{mRo^2}{2F}\left(\frac{W}{1-\frac{mw^2}{K}}\right)^2+\frac{J_2w^2}{2F} \tag{12}$$

$J_{tot}$ can be calculated as a function of s from equation (12).

The equipment illustrated in FIG. 7 is intended or use in a weightless environment, and includes a bed-part 12 provided with a foot-end 13 and intended to support the training person 5. The illustrated embodiment also includes a slide 14 which is movable along said bedpart and on which the training person is intended to lie and to which a flywheel 1 is connected. The bed-part 12 is anchored detacably to adjacent walls or like support structures, with the aid of spring devices 15. The flywheel 1 is connected to a carriage 15 by means of a pull-belt; said carriage being movable along the foot-end of said bed-part and said flywheel being activated by the legs 13' of the training person; via said carriage and said pull-belt. Also shown is an embodiment in which flywheel is located beneath a reclining surface on the bed-part, wherewith the pull-belt extends, for instance, between the flywheel and the carriage via a central recess (not shown) in said bed-pat. The reference 16 identifies a shoulder support and the reference 17 identifies a handle gripped by the training person. The movable mass has been minimized with the illustrated arrangement, in that it is not necessary to move the flywheel relative to the training person.

In the case of the equipment illustrated in FIG. 8, a flywheel is mounted adjacent a bed of more conventional design. In this embodiment, the flywheel is mounted adjacent the foot of the bed, so that the pull-belt can be drawn-out in a direction towards the head of the bed. This embodiment also includes a carriage for supporting the feet of the training person. As will be understood, embodiments are conceivable in which the flywheel, as illustrated in FIG. 7, is located beneath the bed. Because of the low movable mass concerned, the equipment illustrated in FIG. 7 and 8 can be used for advanced strength-training with high movement speeds.

FIG. 9 illustrates an embodiment comprising devices by means of which the training person activates the flywheel or brings influence to bear thereon, these devices preferably being located in the region of the handle part 8 for gripping by the training person and include a safety release arrangement 18 constructed so as to break the connection between the training person ad the flywheel when a given pulling force is exceeded.

The release arrangement of the embodiment illustrated in FIGS. 9 and 10 includes a spring connection 19 between the training person and the flywheel, wherein a release pin 20 in its non-release position, shown in FIG. 9, adopts a latching position in a latching space 21 and, when the pulling force F increases sufficiently, is withdrawn successively from said latching space against a spring force such as to be removed from the latching space when a given pulling force is exceeded, FIG. 10, wherein said connection is broken by removal of the spring 19'' and pin from the handle part by means of a pull-belt connection 22.

The release pin 20 and the latching space 21 are preferably provided in the handle part.

The reference 23 identifies a manual safety-release catch, shown in broken lines, operative to pen the latch space to an extent such as to enable the release pin to leave the latching space, so as to break said connection.

In FIG. 11, the reference 24 identifies a brake arrangement which is operative to retard or stop the flywheel when coiling-in the pull-device 6, the pull-belt 6, with the aid of flywheel energy, said coiling of the belt resulting in an increase in the rotational energy of the flywheel, as a result of pulling-out said pull-device. A stop device 25 is mounted adjacent the pull-device and is intended to be braked/stopped against a damping device 26, therewith distancing the gripping or attachment means, etc. of the training person from the flywheel and restricting coiling of the pull-belt. Also shown is an embodiment which said braking action is achieved by means of one or more springs 27 and a piston-like part 28 intended for action with said springs. In addition to having safety function, the brake arrangement also functions to enable solely concentric training to be carried out by drawing-out the pull-device.

It is often desired to measure or estimate training or training performance quantitatively and qualitatively, not least for research purpose. The reference 29 in FIG. 9 identifies a force or power transducer arranged in the handle part, and more specifically in the seat 30 of the spring 19'. Although not shown, the equipment will also preferably include a rotation speedometer and pull-off speed transducer, preferably placed close to the flywheel. Although not shown, the equipment will also preferably include device for registering, processing and monitoring the training or performance concerned. A number of functions are conceivable in this regard. For instance, the devices for registering, processing, etc. may be constructed to deliver a signal when the speed at which the pull-device is pulled-off (the pull-off speed) varies in an undesirable manner, or when the pulling force falls beneath a predetermined value. The registering devices may also be constructed to recorded work performed ($\sqrt{F \cdot ds}$) and therewith the instantaneous kinetic energy.

The embodiment illustrated in FIG. 12 is essentially the same as that illustrated in FIG. 7, and has a lever arm 32 pivotally suspended at its upper end 31. The lower end 33 of the lever arm is connected to the pull-device and is intended to be activated by the training person, preferably between said ends 31, 33. The lever arm is operative to reduce the pulling force on the flywheel in comparison with an arrangement according, for instance, to FIG. 7, at substantially the same force exerted by the training person.

FIGS. 13–15 illustrate the use of a combined lever arm and flywheel for different types of training. The joint 34 concerned is placed adjacent the pivoted end 31 of the lever arm. As will be seen from the Figures, this arrangement provides a wide variation in training procedures. FIG. 16 illustrates further possibilities of varying the characteristics of the equipment. For instance, the rotational axle of the flywheel, and therewith the point at which the pulling force F engages the flywheel via the pull-device, can take different positions in relation to the end 33 of the lever arm where the pull-device is mounted adjacent said lever arm 32. The system, according to FIG. 16, is determined geometrically by the height h of the rotational axle above or beneath a horizontal line passing through the end 33, and the horizontal distance a of the rotational axle from said end 33.

The length of the lever arm and the prevailing moment arm with which the pull-device attacks the flywheel shall be known. The various characteristics of a training sequence can be determined, with the aid of relatively simple trigonometrical deliberations.

The inventive method and the modus operandi of the inventive equipment will be understood in all essentials from the aforegoing. The muscles concerned are subjected to load by increasing or decreasing the kinetic energy of a flywheel, losses due to friction being very small. The possibility is provided of influencing, inter alia, the pull-off speed, which has a known relationship wit muscle contraction speed, by means of the prevailing moment arm through the thickness of the pull-device and/or by varying the movement of inertia. Thus, a belt coil-one phase will immediately follow a belt pull-off phase, since the rotation of the flywheel will continue with the rotational force imparted thereto during the belt pull-off phase.

The characteristics of the equipment can thus be varied in several ways. For instance, the moment of inertia and/or the geometry of he pull-device can be utilized to vary the relationship between the force exerted and the speed of muscle shortening/muscle lengthening, and the positioning of the flywheel can be utilized, inter valid, to the same end. a constant pull-off speed has been considered in the described exemplifying embodiment. A selected speed profile can be predetermined, predescribed, however. According to one embodiment preferred in many instances, the relationship between the force exerted and the pull-off and coil-on speed of the pull-device respectively can be influence to such an extent that the speed of muscle contraction or muscle extension will be substantially constant or follow another conservative speed profile during a substantial part of a training sequence. By conservative is mean there a "speed maintaining" characteristic. Other magnitudes, such as pulling force in the pull-device, can also be predetermined with regard to their profile. In the light of known data with regard to joint movements such data often specifying the torque occurring in said joints, it is possible to determine, for instance, corresponding pulling forces in the pull-device and training can be adapted to what is known, by predetermining the training conditions with the aid of the possibilities of effecting variations with respect t the characteristics of the equipment.

It will be evident form the aforegoing that the inventive method and inventive equipment afford considerable advantages of the nature mentioned in the introduction. Important advantages include the possibilities of influencing the muscle-loading characteristics concerned and the relatively small weight and size of said equipment.

The invention has been described in the aforegoing with reference to a number of exemplifying embodiments. It will be understood, however, that other embodiments and minor modifications are conceivable without departing from the concept of the invention.

With regard to the possibilities of changing characteristics by varying the position of the flywheel, it will be understood that this does not only apply when a lever arm is provided, but also when the pull-device is activated directly by the training person.

Thus, wide variations with respect to belt thickness are conceivable, for instance an alternating increased and decreased thickness along the belt.

With regard to equipment intended for training in a weightless environment, such equipment can, in principle, also be used in normal environments where gravity prevails. In this case, the equipment is erected on a floor or like support structure. The arrangements illustrated in FIGS. 13–15 need not, in themselves, be configured substantially similar to arrangements according to FIG. 12, but may be configured in some other suitable manner. It can be said generally that ht manner of arranging the flywheel for different purposes can be varied within wide limits.

The invention is therefore not restricted to the afore described and illustrated embodiments, since variations can e made within the scope of the following claims.

We claim:

1. A method for training or exercising muscles, with the aid of training or exercise equipment, and for measuring training conditions, wherein the training person loads the muscles concerned by the steps of: increasing or decreasing the rotational kinetic energy of a rotatably mounted flywheel with a hub by means of an elongate flexible pull-device having two ends, one end being free and the other end being attached to the flywheel hub so that , by the sep of rotating the flywheel in one direction of rotation, said elongate pull-device can be wound around the hub of the flywheel, said flywheel and said pull-device comprising means constraining said pull-device to be wound around said flywheel hub in successive concentric rounds as a radially disposed rolled-up pull-device, the method including the further steps wherein the flywheel is thereafter rotated solely wit the aid of inertia and the pull-device acting with a decreasing movement arm to rotate the flywheel while the pull-device is withdrawn, by the training person pulling on the free end of said pull-device from being wound in said one direction around the flywheel hub followed by the step of the pull-device being coiled-in and wound around the flywheel by inertial rotation of the flywheel, and said withdrawing and coiling-in of the pull-device being repeated as desired by the training person.

2. A method according to claim 1, wherein said elongate pull-device has a transverse cross-section which is flat and which enables the step wherein the flat pull-device is wound around the flywheel hub in successive concentric rounds in a radially disposed roll.

3. A method according to claim 2, wherein the relationship between the force exerted and the rate of muscles contraction and muscle extension of the training person results from the steps of variation of the moment arm, between the wound pull-device and the flywheel axis caused by a thickness variation of the elongate pull-device along the length of said pull-device.

4. A method according to claim 2, including the step wherein the moment arm is varied by means of the elongate pull-device, the thickness dimension of which decreases from the free end to the attached end thereof.

5. A method according to claim 2, including the steps wherein the flywheel is caused to rotate by the training person through the intermediary of a pivotally suspended lever arm which is connected at its lower free end to the free end of the pull-device and the step of operating said lever by a force exerted by the training person on the lever arm between the pivotal suspension of the lever arm and the free end connection to the pull-device.

6. A method according to claim 5, wherein the relationship between the force exerted by the training person and the speed of muscle contraction and muscle extension is changed by the step of changing the position of the a rotational-centre of the flywheel relative to the lever arm.

7. A method according to claim 1, include the step wherein the relationship between the force exerted and the speed of muscle contraction and muscle extension is changed by varying the moment inertia of the flywheel during rotation, by the step of varying flywheel weight distributing.

8. A method according to claim 7, including the step wherein said weight distribution is changed with the aid of at least one weight mounted on the flywheel, and the step wherein said at least one weight is displaced against a spring force as a result of centrifugal force provided by flywheel rotation.

9. A method according to claim 2, including the step wherein the relationship between the force exerted by the training person and the speed at which the pull-device is pulled-off, or coiled on, respectively, is varied to an extent such that the speed of muscle contraction or muscle extension will be substantially constant over a considerable part of the training sequence.

10. A method according to claim 1, including the steps of measuring and recording training conditions and performance.

11. A method according to claim 1, including the step of mounting the flywheel adjacent a bed-part, and detachably anchoring said bedpart to fixed structure by spring means, thereby enabling training, of a training person on said bed, under simulated weightless conditions.

12. Equipment for training or exercising muscles and for measuring training conditions, comprising: a rotatably mounted flywheel, with a hub means, being operative to load muscles of a training person, by an increase or decrease the rotational kinetic energy, of the flywheel; and means or causing rotation of the flywheel solely by the training person and inertial forces the rotating flywheel including an elongate flexible pull-device adapted to be wound around, in one direction, the hub of the flywheel, wherein the elongate pull-device is wound in concentric single rounds on the hub so the the flywheel can be acted upon solely by a force applied through a decreasing movement arm between the pull device and the flywheel axis as said elongate pull-device is pulled off from being wound around the flywheel hub to cause rotation of the flywheel and then again coiled-on the flywheel by continued rotation of the flywheel under inertia process.

13. Equipment according to claim 12, wherein the pull-device comprises an elongate flexible means, halving two ends, which is flat in transverse cross-section, having one end connected to said hub means, and said hub means confines said pull-device to be wound around said hub means in successive concentric rounds as a roll radially extending normal to the flat transverse section of the elongate means.

14. Equipment according to claim 3, wherein the geometrical cross-section shape of the elongate pull-device varies along the length thereof, whereby said moment arm is varied to thereby change the relationship between the force exerted through the pull-device and the speed of muscle contraction or muscle extension.

15. Equipment according to claim 13, wherein measuring devices are provided in connection with said pull-device, said measuring devices enabling measuring and recording of pulling force and rotational speed and coil-on speed of the flywheel.

16. Equipment according of claim 13, wherein a lever arm with two ends is provided and pivotally suspended form one end, the flywheel is intended of be rotated by the training person through the intermediary of said pivotally suspended lever arm, the other end of said lever arm being connected to the other end of said elongate pull-device and said suspended lever arm being intended for operation by force applied to the lever arm between the pivoted suspension end and the said other end which is connected to said pull-device.

17. Equipment according to claim 16, wherein the location of the rotational centre of the flywheel in relation to the suspended lever arm can e changed in order to influence the relationship between the force exerted and the speed of muscle contraction or muscle extension.

18. Equipment according to claim 13, wherein a brake arrangement is provided and is operative on said pull-device to retard or stop the flywheel when coiling-in said pull-device with the aid of flywheel energy, said coiling following an increase in rotational energy of the flywheel by pull-off of said pull-device, said brake arraignment comprising a stow device located on the pull-device and operative to abut against a damping means, therewith to provide a safe distance between the training person and the flywheel.

19. Equipment according to claim 18, wherein the brake arrangement is operative to enable solely concentric training to be carried out, by withdrawing said pull-device.

20. Equipment according to claim 12, wherein the elongate pull-device is flat and the thickness of the elongate pull-device normal to the flat transverse section varies along the elongate dimension thereof.

21. Equipment according to claim 12, wherein the flywheel includes means to change the weight distribution of the flywheel relative to tis axis during rotation of said flywheel, to thereby change the relationship between the force exerted and the speed of muscle contraction or muscle extension.

22. Equipment according to claim 21, wherein the flywheel includes at least one radially movable weight with biasing means adapted to be displaced radially as ar result of centrifugal action due to rotation of the flywheel, so as to redistribute the flywheel weight, said displacement taking place against said biasing means providing an opposing biasing force.

23. Equipment according to claim 21, wherein weights are provided at several radial positions on the flywheel and each of said weights having individually associated opposing biasing force means.

24. Equipment according to claim 12, wherein said pull-device by mans of which the training person can rotate the flywheel includes a handle part and a safety release arrangement in connection with the handle part on the pull-device, said safety release arrangement being constructed to break the connection between the handle part and the flywheel when a given pulling force is exceeded.

25. Equipment according to claim 24 wherein the release arrangement includes a spring connection between the training person and the flywheel, and further includes a release pin intended, when in its unreleased position, to engage a latching position in a latching space and which, when the pulling force increases to a sufficient degree is withdrawn progressively from said latching space against a spring force and which when a given pulling force is exceeded is removed from the latching space so as to break said connection.

26. Equipment according to claim 25, wherein the release pin and the latching space are incorporated in said handle part to be gripped by the training person and are connected to the flywheel via said pull-device.

27. Equipment according to claim 25, wherein a manually operable release latch is provided for the opening of the latch space to an extent so as to enable the release pin to leave said latching space, and to break said connection.

28. Equipment according to claim 12, wherein of the purpose of training in a simulated weightless environment, a bed-part is provided and the flywheel is mounted adjacent said bed-part, and said bed-part is adapted to support the training person and is detachably anchored to a fixed support by means of spring devices.

29. Equipment according of claim 28, wherein the bed-part mounts a slide, movable on and along said bed-part, for supporting the training person in a lying position.

30. Equipment according to claim 28, wherein a carriage is mounted on and movable along said bed-part and intended and is adapted to be activated by the legs of the training person to change said flywheel energy.

31. Equipment according to claim 28, wherein the flywheel is mounted beneath said bed-part and the laying plane of the training person.

* * * * *

UNITED STATES PATENT AND TRADEMARK OFFICE

CERTIFICATE OF CORRECTION

PATENT NO. : 5,242,351

DATED : September 7, 1993

INVENTOR(S) : ERNST H. E. BERG et al.

It is certified that error appears in the above-identified patent and that said Letters Patent is hereby corrected as shown below:

On the Cover Sheet, in the ABSTRACT, line 6, change "or" to --of--.

Column 1, line 29, "he" should be --the--.
, line 56, "muscl" should be --muscle--.
, line 57, "is kinecy" should be --isokinecy--.
, line 61, capitalize --Complicated--.
Column 2, line 64, "pat" should be --part--.
Column 3, line 21, "n" should be --on--.
, line 34, "6k, holed" should be --6, hold--.
, line 46, "stern" should be --pattern--.
, line 49, "width" should be --which--.
Column 5, line 33, the "F" in the formula should be --R--.
Column 6, line 3, the "$J_2$" in the formula should be --$J_1$--.
, line 68, "pen" should be --open--.
Column 7, line 14, insert --in-- before "which".
, line 17, insert --a-- before "safety".
, line 29, "device" should be --devices--.
, line 38, the "✓" in the formula should be --∫--.
Column 8, line 11, "wit" should be --with--.
, line 14, "coil-one" should be --coil-on--.
, line 20, "he" should be --the--.
, line 24, "valid" should be --alia--.
, line 31, "influence" should be --influenced--.
, line 35, "mean there" should be --meant here--.
, line 44, "t" should be --to--.
, line 46, "form" should be --from--.
Column 9, line 6, "ht" should be --the--.

UNITED STATES PATENT AND TRADEMARK OFFICE

CERTIFICATE OF CORRECTION

PATENT NO. : 5,242,351

DATED : September 7, 1993

INVENTOR(S) : ERNST H. E. BERG et al.

It is certified that error appears in the above-identified patent and that said Letters Patent is hereby corrected as shown below:

Claim 1, column 9, line 21, "sep" should be --step--.
, line 29, "wit" should be --with--.
Claim 12, column 10, line 35, after "decrease" insert --in--.
, line 36, "or" should be --for--.
, line 37, after "forces" insert --of--.
, line 38, after "flywheel" insert a comma (,).
, line 42, the first "the" should be --that--.
, line 43, "movement" should be --moment--.
, line 48, "process" should be --forces--.
Claim 13, column 10, lines 50 and 51, "halving" should be --having--.

Claim 17, column 11, line 13, "e" should be --be--.
Claim 18, column 11, line 23, "stow" should be --stop--.
Claim 22, column 11, line 45, "or" should be --a--.

UNITED STATES PATENT AND TRADEMARK OFFICE

CERTIFICATE OF CORRECTION

PATENT NO. :5,242,351

DATED :September 7, 1993

INVENTOR(S) :ERNST H. E. BERG et al.

It is certified that error appears in the above-indentified patent and that said Letters Patent is hereby corrected as shown below:

Claim 24, column 12, line 6, "mans" should be --means--.

Signed and Sealed this

Twenty-ninth Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,242,351 Page 1 of 3

DATED : September 7, 1993

INVENTOR(S) : Ernst H. E. Berg et al.

It is certified that error appears in the above-indentified patent and that said Letters Patent is hereby corrected as shown below:

On cover page, item [76] change "Ernst H.E. Berg" to --Hans Erik Berg--

Column 1, line 19, "rae" should be --rate--.
, line 20, "point" should be --joint--.
, line 20, "generate" should be --greater--.
, line 38, "maximum.. the" should be --maximum. The--.
, line 55, "re" should be -are--.
, line 63, "abnormally" should be --normally--.

Column 2, line 2, "respected" should be --restricted--.
, line 5, change "," to --.--.
, line 20, after "body" insert a period (.).
, line 28, capitalize --The--.
, line 32, "o" should be --of--.

Column 3, line 20, "racket" should be --bracket--.
, line 28, "bound" should be --wound--.
, line 33, before "or" insert a comma (,).
, line 40, before "Constant" insert a period (.).
, line 53, insert a --)-- after "contraction".

Column 4, line 23, "mans" should be --means--.
, line 25, "is" should be --its--.
, line 34, "altering" should be --tapering--.
, line 36, "sped" should be --speed--.
, line 41, "deceases" should be --decreases--.
, line 45, "for" should be --or--.
, line 59, "force" should be --for--.
, line 62, "powerfull" should be --powerful--.

UNITED STATES PATENT AND TRADEMARK OFFICE

SECOND CERTIFICATE OF CORRECTION

PATENT NO. : 5,242,351

DATED : September 7, 1993

INVENTOR(S) : ERNST H. E. BERG et al

It is certified that error appears in the above-identified patent and that said Letters Patent is hereby corrected as shown below:

Column 5, line 21, "characteristic" should be --characteristics--.
, line 24, "t" should be --to--.

Column 6, line 9, "or" should be --for--.
, line 16, "detacably" should be --detachably--.
, line 23, after "which" insert --the--.
, line 51, "ad" should be --and--.
, line 60, after "force" insert a comma (,).

Column 7, line 16, "action" should be --coaction--.
, line 22, "purpose" should be --purposes--.
, line 37, "recorded" should be --record--.

Column 8, line 13, "movement" should be --moment--.
, line 30, after "speed" insert --v--.

Column 9, line 11, "e" should be --be--.
, line 11, change "claims" to --Claims--.

Claims:

Column 9, line 30, "movement" should be --moment--.

Column 10, line 3, "include" should be --including--.
, line 6, after "moment" insert --of--.
, line 8, "distributing" should be --distribution--.

UNITED STATES PATENT AND TRADEMARK OFFICE

SECOND CERTIFICATE OF CORRECTION

PATENT NO. : 5,242,351

DATED : September 7, 1993

INVENTOR(S) : ERNST H. E. BERG et al

It is certified that error appears in the above-identified patent and that said Letters Patent is hereby corrected as shown below:

Column 11, line 3, "of" should be --to--.
, lines 23 and 24, "arraignment" should be --arrangement--.
, line 38, "tis" should be --its--.
, line 45, "ar" should be --a--.

Column 12, lines 47 and 48, "laying" should be --lying--.

Signed and Sealed this

Eighteenth Day of October, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,242,351

DATED : September 7, 1993

INVENTOR(S) : Ernst H.E. Berg, et al

It is certified that error appears in the above-indentified patent and that said Letters Patent is hereby corrected as shown below:

Claim 14, column 10, line 57, "3" should be --13--.

Signed and Sealed this

Eighth Day of November, 1994

Bruce Lehman

*Attest:*

BRUCE LEHMAN

*Attesting Officer*

*Commissioner of Patents and Trademarks*